US005533481A

United States Patent [19]

Kronberger

[11] Patent Number: 5,533,481

[45] Date of Patent: Jul. 9, 1996

[54] FUEL INJECTION SYSTEM

[75] Inventor: Maximilian Kronberger, Steyr, Austria

[73] Assignee: Robert Bosch GmbH, Stuttgart, Germany

[21] Appl. No.: 452,755

[22] Filed: May 30, 1995

[30] Foreign Application Priority Data

Jun. 21, 1994 [DE] Germany ..... 44 21 714.5

[51] Int. Cl.[6] ..... F02B 3/00

[52] U.S. Cl. ..... 123/299

[58] Field of Search ..... 123/299, 501, 123/297, 299

[56] References Cited

U.S. PATENT DOCUMENTS 5,199,398 4/1993 Nylund ..... 123/299
5,231,962 8/1993 Osuka et al. ..... 123/299
5,438,966 8/1995 Teegen ..... 123/297
5,477,834 12/1995 Yoshizu ..... 123/501

*Primary Examiner*—Raymond A. Nelli
*Attorney, Agent, or Firm*—Edwin E. Greigg; Ronald E. Greigg

[57] ABSTRACT

A fuel injection system having a fuel injection pump whose high-pressure delivery is determined by means of an electrically controlled valve, which controls a relief conduit; the phase of the preinjection quantity supply and the main injection quantity supply are determined by the closing of this valve. To increase the precision of the injection, the injection system is provided with an injection valve, whose valve needle withdraws fuel from a damping chamber during the opening stroke via a throttle opening, which decreases with increasing valve needle stroke. Hence the opening motion of the valve needle becomes invulnerable to pressure surges, and the precision of the controlled fuel injection is increased.

2 Claims, 3 Drawing Sheets

FUEL INJECTION SYSTEM

BACKGROUND OF THE INVENTION

The invention is based upon a fuel injection system as defined hereinafter. German patent application DE-A-36 44 257 discloses a system of this kind in which a distributing injection pump is provided as the fuel injection pump; it has a pump piston which is driven to reciprocate and simultaneously rotate, and in its rotating motion and pump stroke supplies fuel brought to injection pressure to one of several injection lines at a time, each of which leads to a fuel injection valve. A pressure valve is provided in each of these injection lines, which, upon high-pressure fuel delivery, opens in the feed direction by means of the fuel injection nozzle, closes at the end of injection, and furthermore has a pressure maintenance valve, which is suitable for reducing pressure waves between the pressure valve and the fuel injection valve and for maintaining a constant standing pressure in this region during the injection pauses, which is what is sought. This is a known provision, which typically serves to assure that, with the standing pressure kept constant in the injection pauses, volumes which are always the same are required in order to bring the fuel quantity, which is present in the region between pressure valve and fuel injection valve, up to the necessary pressure level at the onset of the high-pressure injection. With different residual pressures in this particular region, these fuel quantities can vary widely, and so the high-pressure injection quantity that then actually reaches injection and is metered at the fuel injection pump varies, causing attendant variances in injection quantity. This is typically avoided by means of the aforementioned known pressure valve, which is called an equal-pressure valve. Similar effects can be achieved with so-called equal-volume valves, which draw off a predetermined relief quantity of fuel from the line system between the pressure valve and the fuel injection valve at the moment the closing member of the pressure valve closes. Hence the residual pressure or the standing pressure is also brought to a certain value, which is less than the injection pressure, so that after the end of high-pressure injection, pressure waves surging back and forth between the fuel injection valve and the pressure valve cannot lead to after-injection of fuel into the combustion chamber of the engine.

It is also advantageous, when fuel injection is subdivided into a pre- and a main injection per operating cycle of each of the engine cylinders to be fed, to provide for a well-controlled standing pressure in the injection pauses as well.

In a fuel injection system for introducing pre-and main injection quantities, which according to the preamble to the main claim are controlled by means of an electrically controlled valve, the disadvantage arises, moreover, that upon opening and closing of the electrically controlled valve, considerable pressure surges are produced in the line system. The electrically controlled valves, mostly magnet valves, are designed so that even at high engine speeds, they briefly open and close fast enough, at a high actuation velocity, to be able to control the small fuel injection quantities necessary, even at high engine speeds, for the pre-injection, at a defined interval from the main injection. That requires high switching speeds of the electrically controlled valves, which gives rise to the pressure surges mentioned.

Pressure surges of this kind are especially influential at low engine speeds and particularly in the region between the pre-injection and the main injection, since given the time available there is little opportunity to compensate for pressure waves surging back and forth. These pressure surges, which with regard to their height are effective at the onset of each pre- and main injection, influence the opening or closing of the injection valve. Particularly critical is the opening of the injection valve, since in self-igniting engines, the effective fuel injection onset controls the combustion in the engine and is decisive for performance, exhaust emissions, and engine noise. Another decisive factor, in engines provided with pre- and main injection for fuel supply, is the injection rate and its course during the pre-injection. Furthermore, by the onset of the main injection the preinjected quantity should have been entirely combusted, so that to this end, the injection onset in the main injection is also of considerable importance.

These interrelationships are influenced essentially by the opening behavior of the valve needle of the injection valve. This pressure controlled valve needle reacts essentially to all kinds of pressure conditions, which occur on the one hand due to the high-pressure fuel delivery and on the other hand due to the control of this high-pressure fuel delivery by means of electrically controlled valves.

Furthermore, international patent application WO 90/08 296 discloses a fuel injection valve with which a pre- and a main injection should be realized by means of a the high-pressure delivery of a fuel injection pump. Inside the fuel injection valve, a deflecting piston is provided, which can be deflected counter to the force of a prestressed spring by a certain amount. The pressure impingement on the valve needle of the fuel injection valve is provided parallel to this deflecting piston, which pressure application unblocks an injection opening at the onset of injection by means of the fuel supplied against the force of a prestressed valve spring.

The valve spring is simultaneously also the restoring spring of the deflecting piston. Consequently with this known embodiment and with a corresponding design of the spring, upon the onset of high-pressure delivery by the fuel pump, first an injection is produced, which is then followed by a deflection of the deflecting piston. This deflecting motion withdraws a certain volume from the supplied fuel so that the pressure of the valve needle drops below the opening pressure, especially since the initial tension of the spring would be increased as a result of the motion of the deflecting piston. The valve needle then stays in the closed position until a further pressure increase by means of the further supply of the fuel injection pump, and then opens the injection openings to carry out the main injection.

This control of pre- and main injection depends heavily upon the dynamics and upon the parameters determined by the construction. It frequently leads to interruptions of the course of injection. Sometimes the deflecting piston is deflected too late, so that the pre-injection quantity is increased in an undesired manner; sometimes the preinjection begins too late, so that in proportion to the main injection, too small a pre-injection quantity is injected; and it can also happen that the interruption between pre- and main injection is not pronounced enough. The known fuel injection valve, furthermore, has a damping chamber on the back end of the valve needle, which damping chamber communicates via a throttle connection with the fuel-filled chamber which contains the spring. This chamber is at low pressure, such as the pressure of the prefeed pump of the fuel injection pump, or the return pressure. The throttle restriction between the damping chamber and the fuel filled chamber is embodied such that the valve needle at first unblocks a relatively large throttle cross section in its starting or closed position, but then this throttle cross section is reduced in the course of the opening movement of the valve needle, so that an increasing damping effect or an increasing restoring force acts upon the valve needle. The construction in this known fuel injection valve, which is discussed in connection with the control of the pre-injection, is intended to enable an exact separation between pre- and main injection, taking into consideration the dynamic behavior of the deflecting piston, which at the same time also influences the opening behavior of the valve needle. The opening movement of the valve needle is slowed down by means of the throttle opening so that by the volumetric removal of the valve needle, i.e., the fuel volume displaced by it at the onset of the pre-injection, the speed of the pressure drop in the fuel pressure acting upon the valve needle is not overly high. This is especially effective in the low engine speed region, where the fuel delivery rate of the fuel injection pump is lower and consequently pressure drop caused by the opening of the valve needle cannot be compensated for fast enough. This provision is especially also significant for the production of the deflecting movement of the deflecting piston, which produces the interruption between pre- and main injection.

In contrast, in the defined fuel injection pump, the subdivision between pre- and main injection is controlled at targeted times by the magnet valve alone. Here, different disadvantages, which have already been described at the beginning, occur due to the rapid switching movements of the electrical control valve, which movements have strong pressure surges.

OBJECT AND SUMMARY OF THE INVENTION

The object of the invention is to prevent these disadvantages with their effects upon the precision of injection in a fuel injection pump of this type.

By means of the embodiment according to the invention, pressure surges, which can be ascribed to the switching movements of the electrically controlled valve, and which would influence the dynamics of the valve needle of the fuel injection valve, are reduced because, while the valve needle reacts quite quickly, by means of the electrically controlled valve, to an increase of the pressure or to the control of the injection onset by closing the relief of the pump work chamber, nevertheless the movement of the valve needle is advantageously controlled. Because of the progressive reduction of the cross section of the throttle opening upon deflection of the valve needle, its movement is essentially independent of various pressure increase speeds or pressure surges. The valve needle carries out a steady stroke movement, which is controlled by the throttle opening or by the fuel flowing out at this opening. In the reverse, when the pump work chamber is rapidly relieved via the electrically controlled valve to end the pre-injection and when pressure waves resulting from this occur between the fuel injection pump and the fuel injection valve, then from the beginning of the reversal of the movement of the valve needle toward the closed position as a result of cavitation in the damping chamber there is practically no effective throttling, and so the desired rapid closing motion of the valve needle is attained. In connection with the quick switching, electrically controlled valve, new advantages are consequently attained, as well as positive effects on the outcome of control of the fuel injection system according to the invention. Advantageous improvements of the embodiment according to the invention are given hereinafter, and advantageous adaptations to suit the particular injection system and its dynamics are possible.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
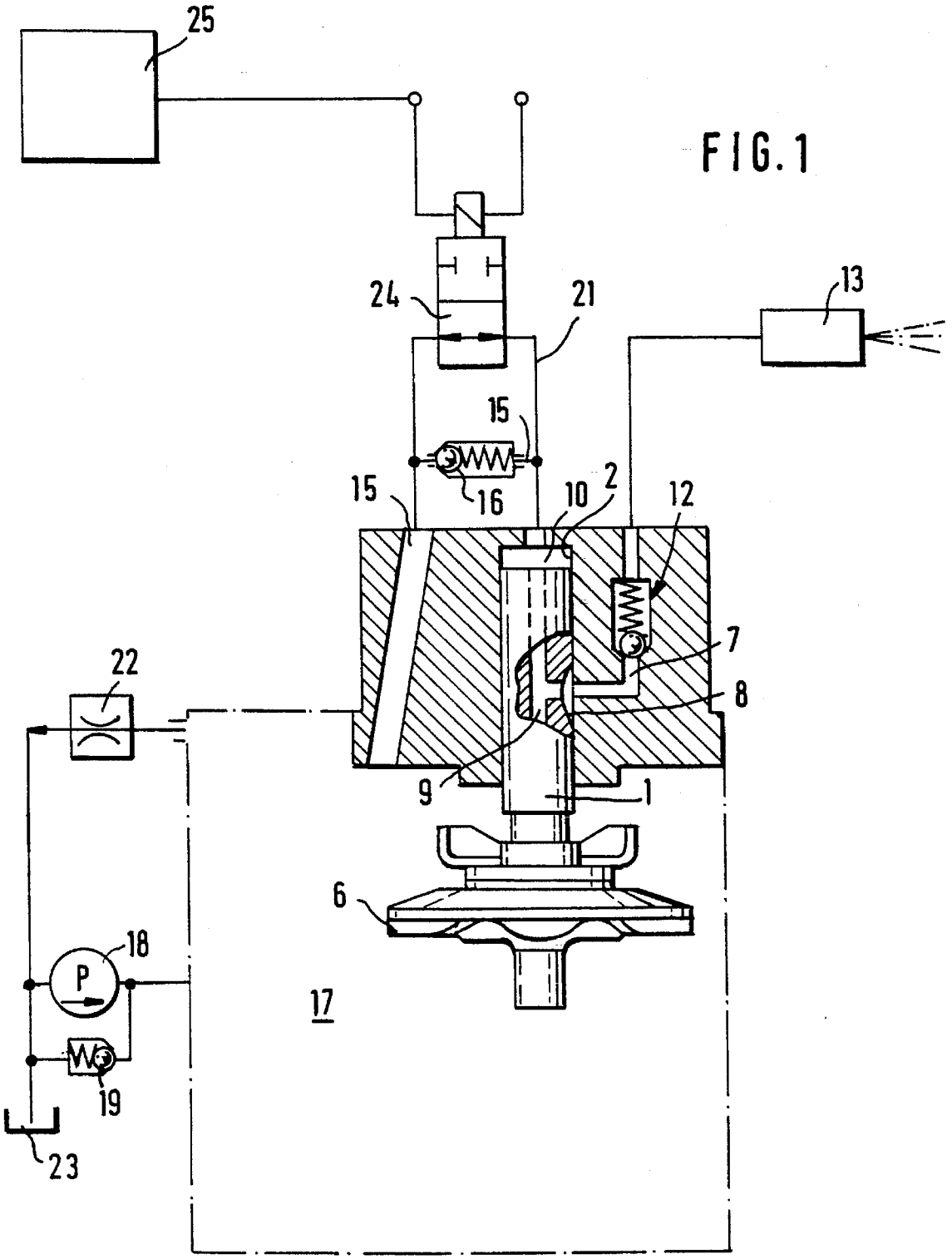
FIG. 1 shows a schematic representation of a fuel injection pump, which is controlled by a magnet valve.

The embodiment according to the invention can be realized using a distributing injection pump, as schematically represented in FIG. 1. This involves a distributing injection pump of the axial piston type, although the subject of the invention can also be employed in different fuel injection pumps, as for example distributing injection pumps of the radial piston type, or individual pumps having only one pump piston for feeding an individual cylinder of an engine, or in-line pumps. In the type of distributing injection pump shown in FIG. 1, a pump piston 1 is provided, which is disposed in a cylinder bore 2 so that it can slide and rotate, and encloses with its face end therein a pump work chamber 10. The pump piston is coupled, for example via a spring, not shown further, to a cam disk 6, which has cams pointing axially downward. The cam disk is driven to rotate in a known manner by a drive shaft, not shown further; the cam disk, influenced by the spring, runs on a known axially fixed roller ring and as a result, sets the pump piston into a reciprocating, pump and intake motion. In its rotational movement in relation to a pump feed stroke, in which fuel is displaced from the pump work chamber 10 at high pressure, the pump piston comes into communication with one of several injection lines 7 via a distributing groove 8 in the jacket face of the pump piston. The distributing groove communicates continuously with the pump work chamber via a longitudinal conduit 9. The injection line leads via a one-way pressure valve 12 to a fuel injection valve, which is associated with the respective cylinder of an engine.

Fuel is supplied to the pump work chamber 10 via an intake line 15, which extends from an intake chamber 17, which is enclosed inside the housing of the fuel injection pump and which is essentially represented only by a broken line. The intake chamber receives fuel from a fuel feed pump 18, which is driven synchronous to the fuel injection pump, e.g. by the drive shaft, and consequently feeds fuel into the intake chamber in quantities, which depend upon the speed of the engine. With the help of an additional pressure control valve 19, the pressure in the intake chamber is usually controlled depending upon the engine speed, if additional functions of the fuel injection pump should be controlled with the help of this pressure. Fuel flows continuously back to the reservoir 23 via an overflow throttle 22 so that a cooling of the injection pump thus produced or a degassing of the injection chamber is provided for. The intake line 15 leads via a one-way check valve 16 into the pump work chamber; the check valve opens toward the pump work chamber. Parallel to this check valve, an electrically controlled valve 24 is provided, which controls a bypass line 21 to the pressure valve 16 and with its help, upon opening of the valve, a communication between pump work chamber 10 and intake chamber 17 is produced and upon closing of the valve, the pump work chamber 10 is closed. The electrically controlled valve 24, which is symbolized as a magnet valve, is controlled in a known manner by a control device 25, in accordance with operational parameters.

With the help of this electrically controlled valve, which for example upon the intake stroke of the pump piston directs fuel not only to the check valve 16 but also to the pump work chamber, the onset of the high-pressure delivery of the pump piston is controlled such that the injection onset is also controlled with the help of this valve. Upon closing of this valve, injection pressure builds up in the pump work chamber 10, which pressure is supplied via the longitudinal conduit 9 and the distributing groove 8 to one of the injection lines 7. When the electrically controlled valve opens once again, this high-pressure delivery is interrupted, so that the closing time of the valve determines the injection time and the injection quantity. A pre-injection can also be realized by means of this valve by its being closed at the onset of the pre-injection, opened again after metering of the pre-injection quantity, then closed again after a pause via the supply onset for the main injection, and opened once more to end the main injection.

Figure 2:
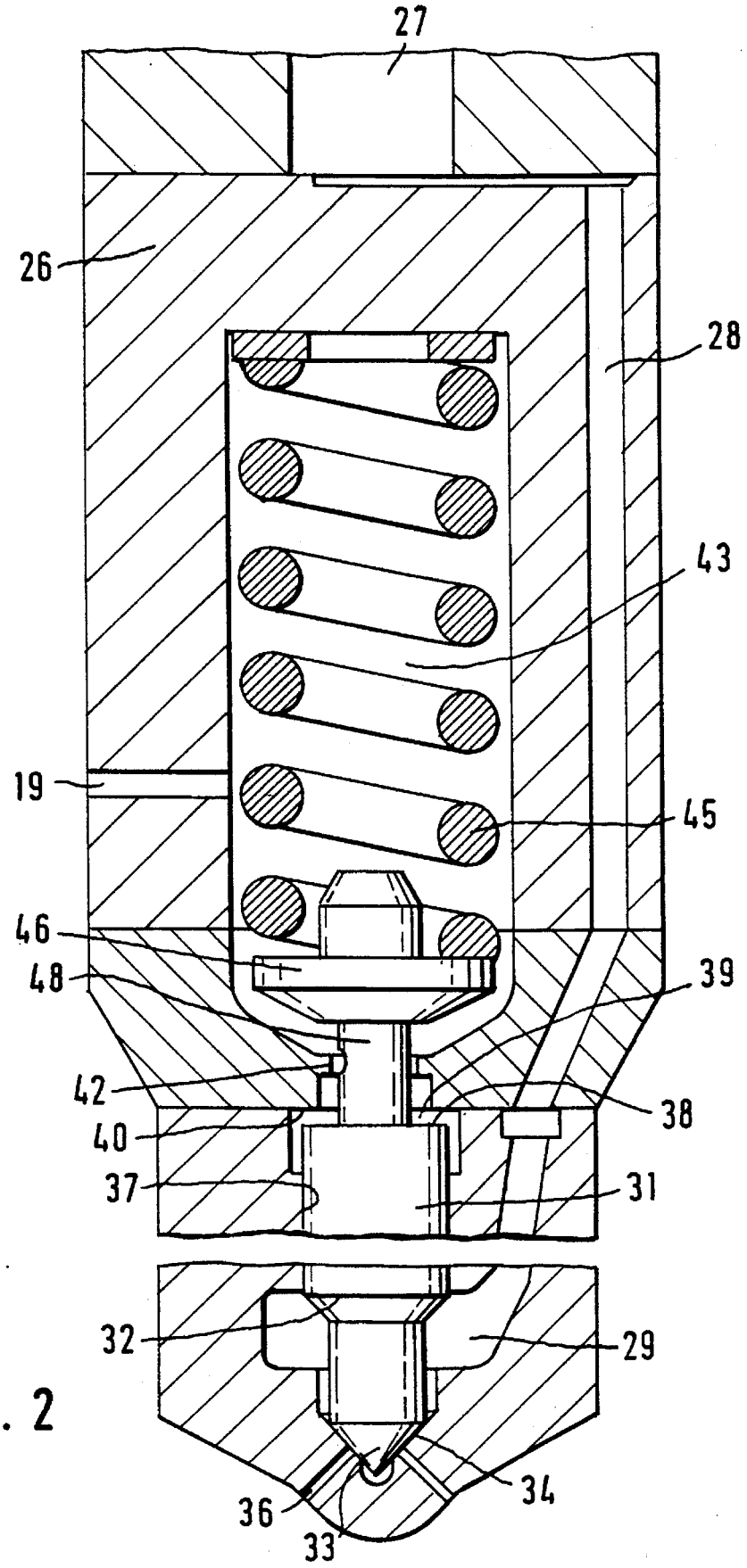
FIG. 2 shows a longitudinal section through the middle part of a first exemplary embodiment of a fuel injection valve as a part of the fuel injection system according to the invention.

FIG. 2 shows a section through part of the fuel injection valve, which is merely indicated in FIG. 1. In the fuel injection valve, fuel is supplied via a supply bore 27 in the housing 26 of the fuel injection valve, which fuel is then supplied to a pressure chamber 29 via a pressure conduit 28. A valve needle 31, having a pressure shoulder 32 oriented toward the pressure chamber, protrudes into this pressure chamber, from which pressure shoulder the valve needle extends with a tapered diameter, then becomes a cone tip 33, with which tip injection bores 36 feeding into a valve seat 34 are closed, as long as the valve needle is situated having its cone tip in contact with the valve seat. The valve needle is guided in a longitudinal bore 37 and protrudes with its back end 38 into a damping chamber 39, whose limiting wall disposed opposite the back end 38 constitutes a stop 40 for the valve needle.

Coaxial to the axis of the valve needle, a connecting opening 42 leads from the damping chamber 40 into a fuel-filled chamber 43 disposed inside the fuel injection valve. A pressure spring 45 is disposed in this fuel-filled chamber 43, which spring is supported fixed to the housing and on the other end, rests against a spring plate 46, which is pressed by the prestressed pressure spring onto a pressure pin 48, which protrudes through the connecting opening 41 from the fuel-filled chamber into the damping chamber 39 and transmits the force of the pressure spring 45 onto the valve needle 31.

Figure 3:
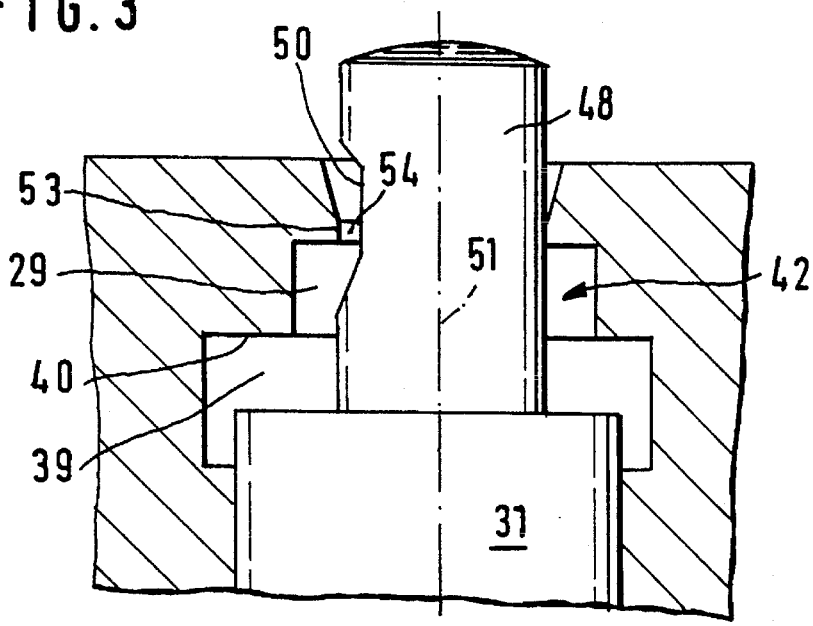
FIG. 3 shows a first exemplary embodiment of the part of the fuel injection valve according to FIG. 2, which part is essential to the invention.
Figure 4:
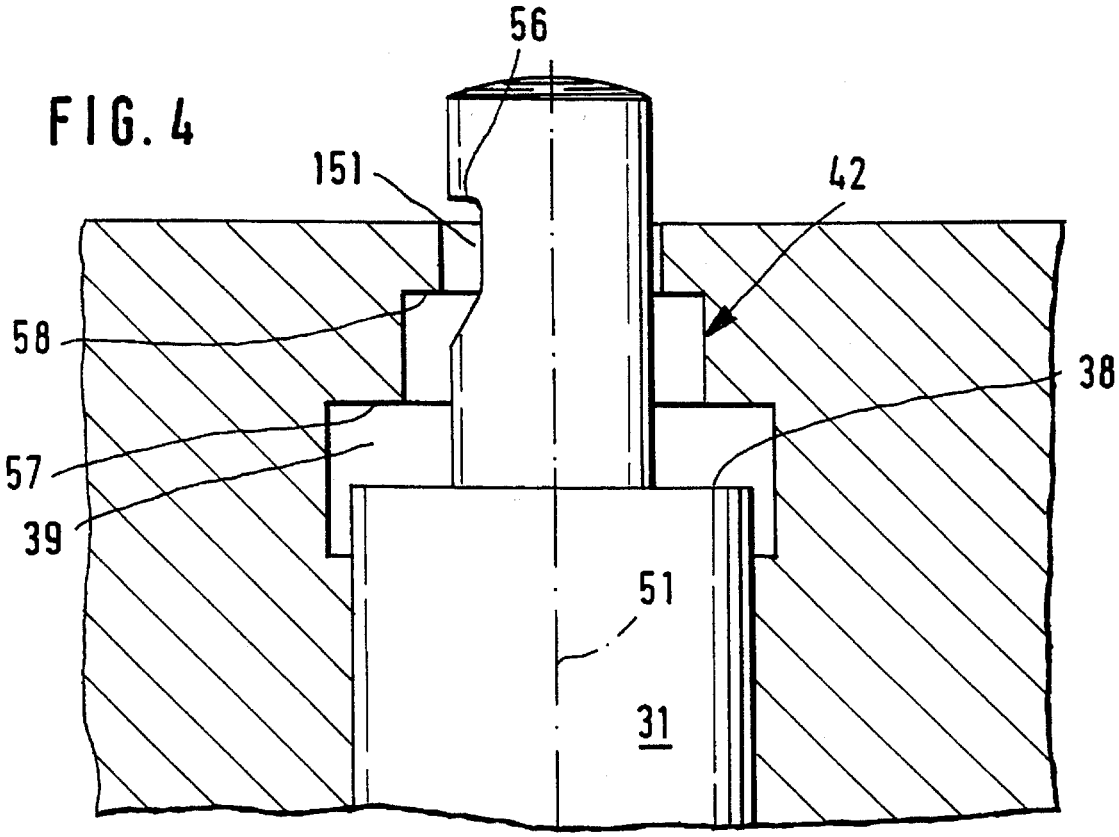
FIG. 4 shows a second exemplary embodiment of the part of the fuel injection valve, which part is essential to the invention.

As shown on a larger scale in FIGS. 3 and 4, the pressure pin 48 has a recess 50, which in FIG. 3 has a trapezoidal course in a plane running along the axis 51 of the valve needle. FIG. 3 shows the valve needle in its starting position, which corresponds to closed injection bores. By means of its shape, the recess 50 connects the damping chamber 39 with the fuel-filled chamber 43. Furthermore, the connecting opening is embodied in this exemplary embodiment so that from the fuel-filled chamber, it narrows like a funnel and thus forms a throttle lip 53 at the transition to the damping chamber, which together with the recess 50 forms the cross section of a throttle opening 54. For this embodiment of a throttle lip, if the connecting opening is a bore, it is favorable to embody this bore on the damping chamber side as a stepped bore between fuel-filled chamber 43 and damping chamber so that another step first follows the throttle lip 53, and only then is the transition to the stop 40 produced.

The cross section of the throttle opening 54 is largest in the position shown, and then is increasingly reduced due to the upward motion of the valve needle having the inclined side limiting wall of the recess 50, which forms the trapezoidal shape.

A second embodiment form is shown in FIG. 4. Here, the recess 151, toward the side of the fuel-filled chamber 43, is provided with a limiting wall 56, which is situated in a plane radial to the axis 51 of the valve needle, while the limiting wall 57 of the recess pointing toward the damping chamber 39 extends at an oblique angle to the axis 51. The connecting opening, on the other hand, is embodied as a stepped bore and in the present case, has no throttle lip. Here, the edge 58 pointing toward the damping chamber, together with the recess 151, constitutes the throttle cross section, which changes continuously with the stroke of the valve needle.

Besides the continuous change of the throttle cross section realized in FIGS. 3 and 4, a stepped reduction of the throttle cross section can also be produced by means of a corresponding embodiment of the recess 50 or 151. It is essential that at the beginning of the valve needle stroke, a maximum cross section is available as an overflow cross section between the damping chamber 39 and the chamber 43, which cross section can be relieved via a relief bore 59 and can also be supplied via this bore with fuel which is at low pressure. This fuel can be taken out of the return of the fuel injection pump, the intake chamber, or a leak line. Leaking fuel also enters from the pressure chamber 59 by way of where the valve needle enters the damping chamber 39, so that this chamber is always filled with fuel. The throttling of the relief of the damping chamber 39, which initially is only slight, in principle brings about a controlled lifting of the valve needle when pressure impinges by means of injection pressure upon its pressure shoulder 32, so that an uncontrolled pressure drop does not occur in the pressure chamber 29. Upon further movement of the valve needle, the damping increases with decreasing throttle cross section so that the valve needle carries out a controlled, steady opening motion until it reaches its stroke stop. The flow rate increases with the square root of the injection pressure, thus decteasingly. Hence upon the opening movement of the valve needle, the dependence of pressure surges is reduced and the injection result is reduced to a great extent independently of uncontrollable dynamic stroke fluctuations in the injection system, which arise as a result of sudden loading and relief of the system via the electrically controlled valve. The injection precision is essentially increased in connection with the possibility of controlling quantity and time of the pre-injection depending upon many parameters.

If the altering of the cross section during the course of the opening motion of the valve needle up to its highest opening stroke is arranged in such a way, by means of appropriate embodiment of the recess on the pin, that the throttle cross section is large at the beginning of the opening stroke of the valve needle, then in particular is increasingly reduced and finally is enlarged again after that, then a quicker opening movement of the valve needle at the end of the injection phase is attained. This increase of the opening speed of the valve needle produces a higher injection rate toward the end of the injection phase, which leads on the whole to a shortening of the injection duration. The throttle cross section or the connecting cross section between damping chamber and fuel-filled chamber can certainly be larger at the end of the valve needle stroke than the throttle cross section at the beginning of the valve needle stroke. Such cross sections can be realized in a simple manner by means of ground surfaces on the pressure pin, which surfaces cooperate with both limiting edges of a cylindrically embodied connecting opening 41.

The closing motion of the valve needle is hardly impeded because of the rapidly increasing cross section and due to the cessation of the damping effect of the damping chamber 39 so that the valve needle closes very quickly after the end of injection and the pre-injection time or the main injection can be precisely ended.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection system comprising a fuel injection pump having a pump work chamber (10) and a fuel injection valve (13) which is supplied with fuel from the pump work chamber and brought to injection pressure, an electrically controlled valve (24), via which the pump work chamber (10) of the fuel injection pump communicates with a relief chamber (17) and in a closed position controls injection quantity and injection duration and interrupts an injection between a pre-injection and a main injection for the control of at least one injection opening (36), the injection valve (13) has a valve needle (31), which is acted upon in the opening direction by the fuel supplied from the pump work chamber (10) and is loaded in the closing direction by a spring (45), which is disposed in a fuel-filled chamber (43) which is relieved of high pressure, and the valve needle (31) on its side remote from the injection opening (36) defines a damping chamber (39) whose axial limiting wall constitutes a stop (40) for defining a stroke motion of the valve needle (31) and which communicates with the fuel-filled chamber (43) via a throttle opening, wherein the throttle opening is constituted by a connecting opening (42) between the damping chamber and the fuel-filled chamber and by a recess (50) on a pressure pin (48), which protrudes through said conecting opening into the fuel-filled chamber, is loaded by the spring, and is moved by the valve needle, wherein by means of said recess on the pressure pin, the cross section of the throttle opening (54) is large at the beginning of the valve needle stroke in the opening direction and is reduced in the course of the valve needle stroke motion.

2. The fuel injection system according to claim 1, in which the cross section of the throttle opening, after a stroke phase having a reduced cross section is enlarged once again at the end of the valve needle stroke motion.

* * * * *